US009366073B1

(12) United States Patent
Ory, Jr.

(10) Patent No.: US 9,366,073 B1
(45) **Date of Patent: *Jun. 14, 2016**

(54) CONNECTING ADAPTER FOR ATTACHING EDGES OF RIGID PANELS OVER WINDOW AND DOOR OPENINGS

(71) Applicant: Cyprexx Services, LLC, Brandon, FL (US)

(72) Inventor: Ronald J. Ory, Jr., LaPlace, LA (US)

(73) Assignee: Cyprexx Services, LLC, Brandon, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/850,439

(22) Filed: Sep. 10, 2015

Related U.S. Application Data

(62) Division of application No. 14/582,377, filed on Dec. 24, 2014, now Pat. No. 9,169,689.

(60) Provisional application No. 61/921,228, filed on Dec. 27, 2013.

(51) Int. Cl.
*E06B 9/00* (2006.01)

(52) U.S. Cl.
CPC ..... *E06B 9/00* (2013.01)

(58) Field of Classification Search
None
See application file for complete search history.

(56) References Cited

U.S. PATENT DOCUMENTS

| | | | | | |
|---|---|---|---|---|---|
| 2,282,061 | A | | 5/1942 | Jasperson | |
| 2,675,071 | A | | 4/1954 | Humphrey | |
| 2,777,174 | A | * | 1/1957 | Carr | E06B 9/04 49/465 |
| 3,356,404 | A | | 12/1967 | Peters | |
| 4,203,256 | A | | 5/1980 | Mowry | |
| 4,562,666 | A | | 1/1986 | Young | |
| 5,343,668 | A | | 9/1994 | Gonzalez | |
| 5,457,921 | A | | 10/1995 | Kostrzecha | |
| 5,507,118 | A | * | 4/1996 | Brown | E05C 9/06 248/173 |
| 5,673,883 | A | | 10/1997 | Figueroa | |
| 5,722,206 | A | * | 3/1998 | McDonald | E06B 9/02 49/463 |
| 6,314,690 | B1 | | 11/2001 | Lilie | |
| 6,330,768 | B1 | * | 12/2001 | Rodrigues | E06B 5/12 248/354.3 |
| 6,502,355 | B1 | | 1/2003 | Bori | |
| 6,532,704 | B2 | | 3/2003 | Hart | |
| 6,910,312 | B2 | * | 6/2005 | Whitworth | E06B 9/02 52/127.2 |
| 6,968,660 | B1 | | 11/2005 | Novoa | |
| 7,748,168 | B2 | * | 7/2010 | Ferrara | E06B 9/04 49/463 |
| 7,805,898 | B1 | | 10/2010 | Everitt | |
| 8,074,408 | B1 | | 12/2011 | Motosko | |
| 8,297,011 | B2 | * | 10/2012 | Quick | E05C 19/003 248/354.3 |
| 8,371,054 | B2 | | 2/2013 | Casterline | |
| 8,490,346 | B2 | * | 7/2013 | Wedren | E06B 9/00 49/463 |
| 8,656,664 | B2 | * | 2/2014 | Glass | E06B 9/01 49/57 |
| 8,756,883 | B2 | * | 6/2014 | Glass | E06B 5/025 49/170 |
| 2006/0179735 | A1 | * | 8/2006 | McNelis | E06B 9/02 52/202 |

* cited by examiner

*Primary Examiner* — Brian Glessner
*Assistant Examiner* — Adam Barlow
(74) *Attorney, Agent, or Firm* — Brian S. Steinberger; Law Offices of Brian S. Steinberger, P.A.

(57) ABSTRACT

Systems, devices, apparatus, kits and methods of attaching rigid panels over door and window openings of structures such as buildings and houses, with connecting adapters attached to the panels by fasteners, and a security rod slid into holes on the adapters with ends that abut against portions of the adjacent frames and casings about the openings. The fasteners can fasten the adapters to the outside of the rigid panels which cover the outer opening.

19 Claims, 7 Drawing Sheets

CONNECTING ADAPTER FOR ATTACHING EDGES OF RIGID PANELS OVER WINDOW AND DOOR OPENINGS

This application is a Divisional Patent Application of U.S. patent application Ser. No. 14/582,377 filed Dec. 14, 2014, now U.S. Pat. No. 9,169,689, which claims the benefit of priority to U.S. Provisional Patent Application Ser. No. 61/921,228 filed Dec. 27, 2013. The entire disclosure of each of the applications listed in this paragraph are incorporated herein by specific reference thereto.

FIELD OF INVENTION

This invention relates to securing openings, and in particular to systems, devices, apparatus, kits and methods of attaching rigid panels, over window and door openings of vacant and/or damaged buildings and houses, with connecting block adapters attached to the lower corners of the panels by fasteners, and security bars slid into holes on the adapters with ends that abut against portions of the adjacent frames and casings about the openings.

BACKGROUND AND PRIOR ART

In the last decade, there has been an increase in the number of buildings and houses, where the property owner has left the property due to property owners defaulting on loans that are higher than the actual value of the property, and/or leaving properties that have been damaged by storms, or vandalism, and the like. As such, lenders and mortgage companies have the need for property preservation to secure the empty and vacant buildings and houses.

Vacant structures often have broken windows, which are an attractive nuisance for vagrants, criminals and children that can result in thefts and destruction of interiors of the structures, as well as be unsafe and dangerous to persons entering the property Boarding up openings with plywood and traditional shutters, can be both expensive, and time consuming. Additionally, using fasteners, such as nails, screws, bolts to directly attach boards and shutters can cause further damage to the property.

Additionally, boards and shutters are generally opaque and do not allow light therethrough. As such, the interiors of the structures are darkened which can result in further problems by having darkened interiors at all times.

Furthermore, the use of boards and shutters gives an immediate indication to a passerby that the property is vacant, which further attracts vagrants, criminals and children that can cause undesirable problems such as damage to the property.

Still furthermore, the appearance of boarded up windows and opaque shutters are both unsightly and can lower the property values for the buildings and houses.

As such, there exists a need to allow for simple and easy securing of the buildings and houses for property preservation. Additionally, there is a need for securing openings to the property with panels that are transparent and let light into the structures, and can give the appearance of the property not being vacant.

Thus, the need exists for solutions to the above problems with the prior art.

SUMMARY OF THE INVENTION

A primary objective of the present invention is to provide systems, devices, apparatus, kits and methods of attaching transparent plastic panels over door and window openings of vacant buildings and houses, with connecting block adapters attached to the lower corners of the panels by fasteners, and security bars slid into holes on the adapters with ends that abut against portions of the adjacent frames and casings about the openings.

A secondary objective of the present invention is to provide systems, devices, apparatus, kits and methods for securing openings such as windows and doors of vacant and/or damaged buildings and houses that can be easily attached without causing permanent damage to the openings.

A third objective of the present invention is to provide systems, devices, apparatus, kits and methods for securing openings such as windows and doors of vacant and/or damaged buildings and houses that is easily and inexpensively attached to the openings.

A fourth objective of the present invention is to provide systems, devices, apparatus, kits and methods for securing openings such as windows and doors of vacant and/or damaged buildings and housings, using transparent panels to allow light inside.

A fifth objective of the present invention is to provide systems, devices, apparatus, kits and methods for securing openings such as windows and doors of vacant and/or damaged buildings and houses, that gives the appearance of the openings not being vacant nor boarded up or closed with shutters.

A sixth objective of the present invention is to provide systems, devices, apparatus, kits and methods for securing openings such as windows and doors of vacant and/or damaged buildings and houses, that is not unsightly and does not result in lowering of the property value of the buildings and houses.

A securing system for covering openings to buildings and housings, can include a rigid plastic panel sized to cover at least one exterior opening through a frame casing to a structure, at least one pair of securing block adapters, each being sized to overlap both left and right corners of the transparent plastic panel and portions of the frame casing, fasteners for attaching the transparent plastic panel to portions of the block adapters, and a securing bar attached to other portions of the block adapters, so that the transparent plastic panel is on an exterior side of the structure opening and the block adapter with securing bar are on an interior side of the structure opening.

The panel can be selected from at least one of a solid acrylic material, a solid transparent resinous material, or a transparent polycarbonate material.

Each of the block adapters each can include a first opening for a fastener, and a second opening perpendicular to the fastener opening for allowing a portion of the securing bar to be inserted therein.

The block adapters can include materials selected from wood, stainless steel, galvanized metal and aluminum. The block adapters can be formed from rigid plastic material identical to the rigid plastic panel.

The structure opening can include a window having glass attached to the frame casing.

The fasteners can include bolts and nuts, and/or screws and nuts.

A method of securing openings on structures, can include the steps of sizing a rigid plastic panel to fit over an opening to a structure, providing at least a pair of securing block adapters, providing at least one securing bar, positioning the rigid transparent plastic panel over the exterior of the structure opening, positioning one of the securing block adapters to overlap over a lower left corner portion of an interior to the structure opening and over a portion of a lower left corner of a frame casing about the structure opening, positioning another one of the block adapters to overlap over a lower right corner portion of an interior to the structure opening and over a portion of a lower right corner of a frame casing about the structure opening, attaching the block adapters to the sized rigid plastic panel with fasteners, and sliding the securing bar through openings in the block adapters so that ends of the block adapters abut against portions of the frame casing on both sides of the structure opening, wherein the structure opening is securely covered and protected by the rigid transparent plastic panel.

The plastic panel can be selected from a solid transparent acrylic material, a solid transparent resinous material, or a transparent polycarbonate material.

Each of the block adapters can include a first through-hole for the fastener, and a second through-hole perpendicular to the first through-hole for the securing bar.

The block adapters can include materials selected from wood, stainless steel, galvanized metal and aluminum.

The block adapters can be formed from rigid plastic material identical to the rigid plastic panel.

The structure opening can include a window having glass in the frame casing.

The fasteners can include bolts and nuts and/or screws and nuts.

A protection kit for covering openings to buildings and housings, can include a rigid plastic panel sized to cover at least one exterior opening through a frame casing to a structure, at least one pair of securing block adapters, each being sized to overlap both left and right corners of the plastic panel and portions of the frame casing, fasteners for attaching the transparent plastic panel to portions of the block adapters, and a securing bar attached to other portions of the block adapters, so that the transparent plastic panel is on an exterior side of the structure opening and the block adapter with securing bar are on an interior side of the structure opening.

Each of the block adapters can include a first opening for a fastener, and a second opening perpendicular to the fastener opening for allowing a portion of the securing bar to be inserted therein.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

The components will now be described.

Figure 1:
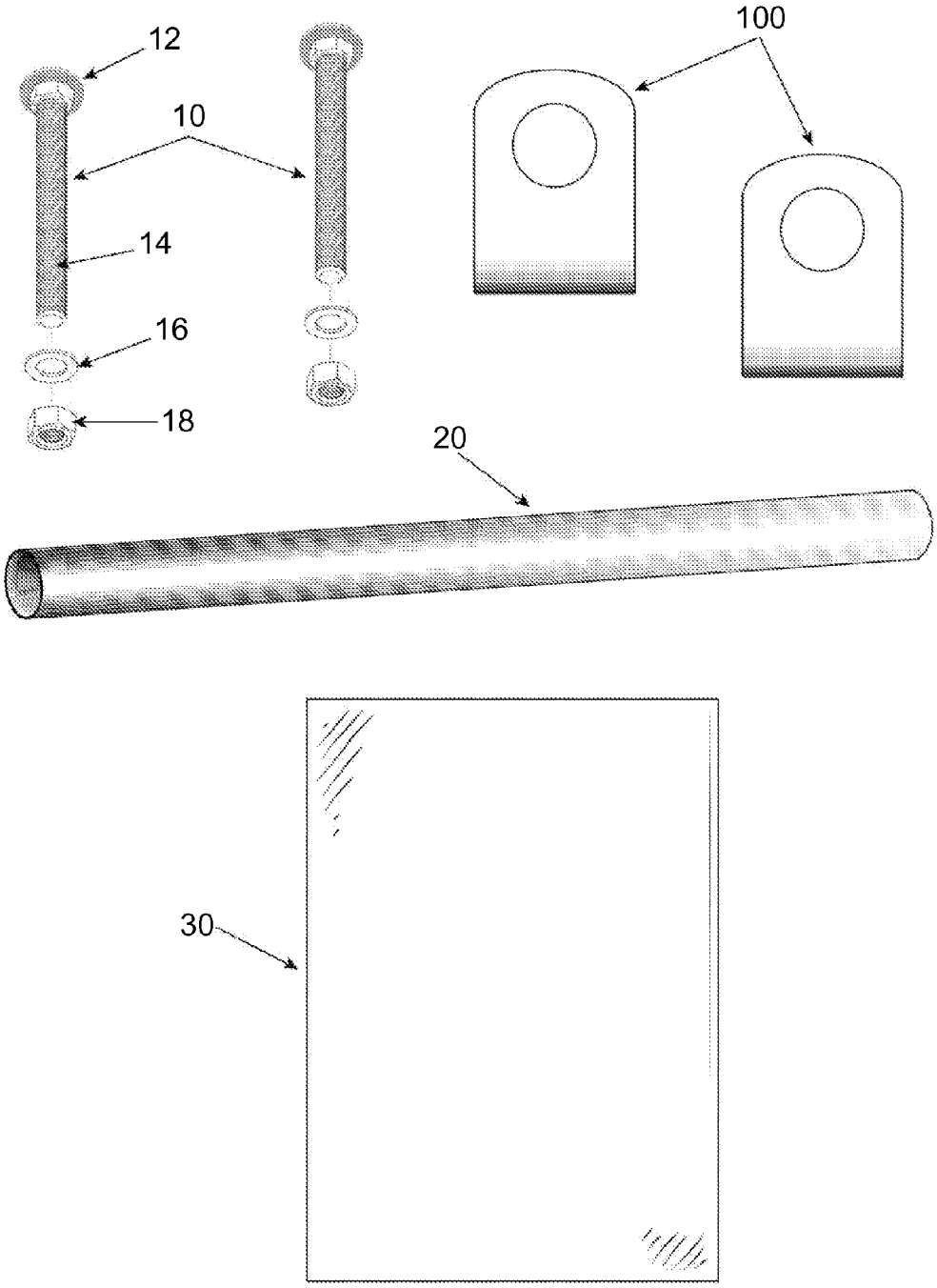
FIG. 1 is an exploded view of the novel block adapters, with fasteners and securing bar and plastic sheet for use with protecting window openings to a building or house.
Figure 2A:
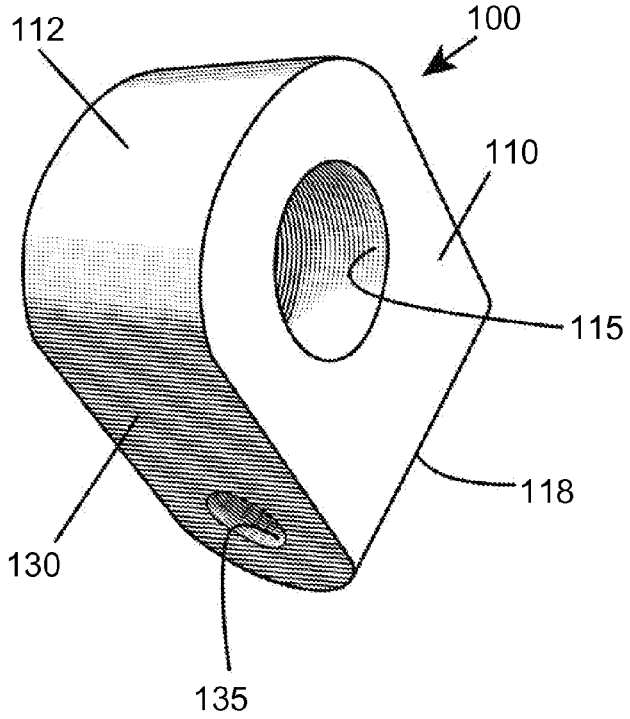
FIG. 2A is an enlarged upper front left perspective view of a novel block adapter of FIG. 1.
Figure 2B:
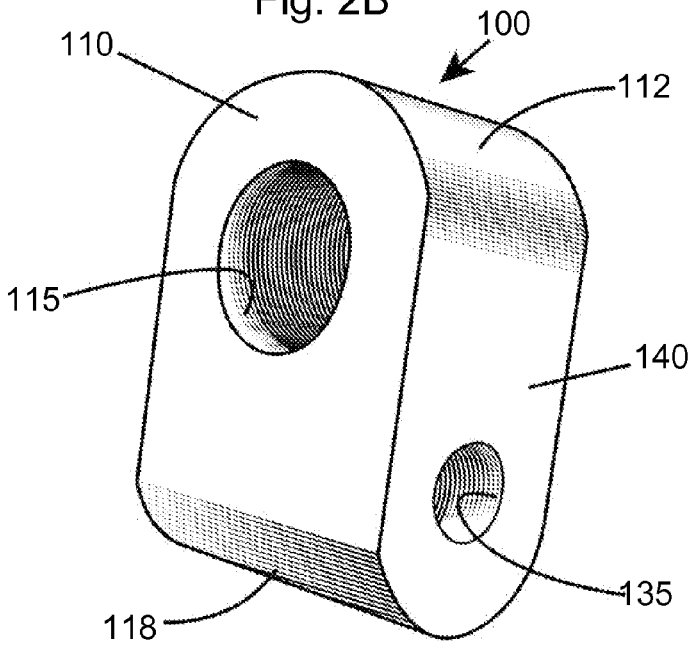
FIG. 2B is an upper front right perspective view of the block adapter of FIG. 2A.
Figure 2C:
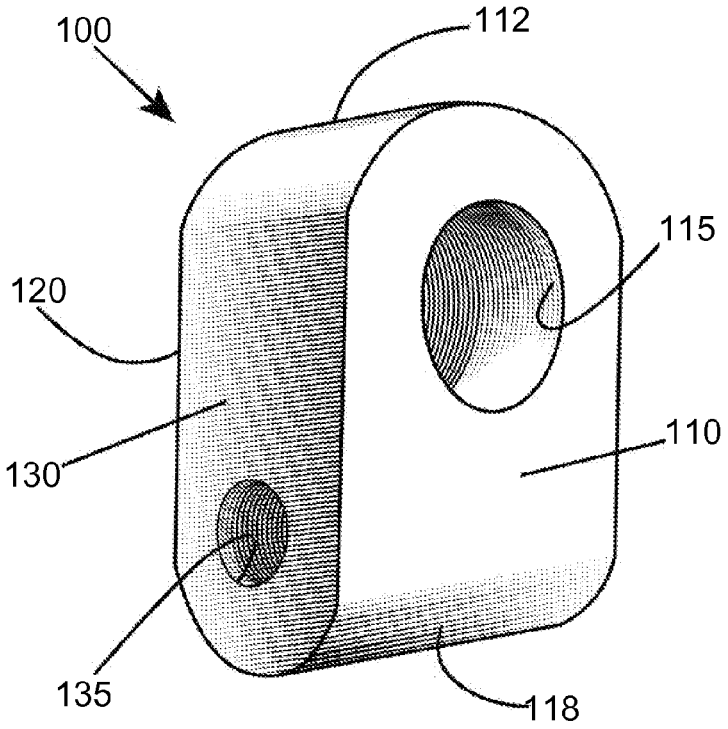
FIG. 2C is another left front perspective view of the block adapter of FIG. 2A.
Figure 2D:
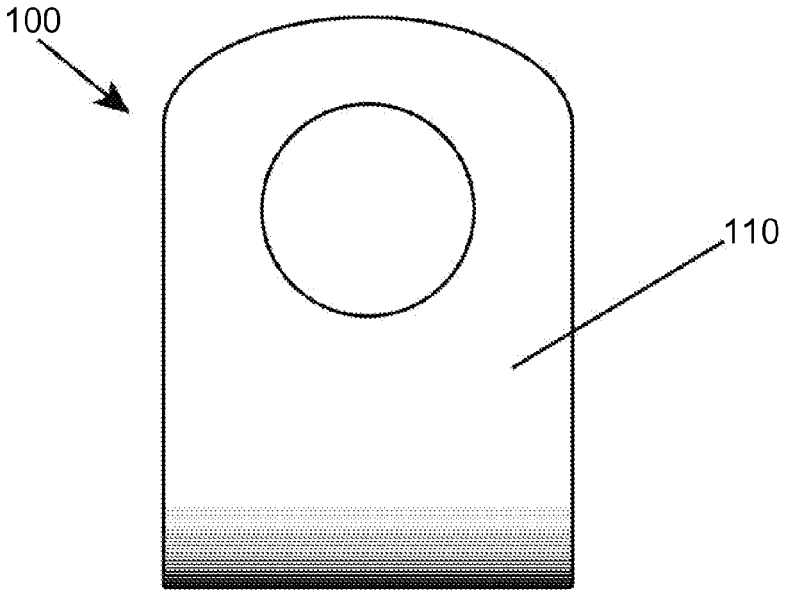
FIG. 2D is a front view of the block adapter of FIG. 2A.

10 fasteners such as carriage bolt(s) and screws
12 fastener head(s)
14. threads
16 washer(s)
18 nut(s)
20 bar/pipe
22 caps
30 plastic sheet/panel
100 block adapter(s)
110 flat front face
112 convex curved top
115 fastener through-hole
118 convex curved bottom
120 flat rear face
130 left flat side
135 securing bar through-hole
140 right flat side
200 assembled view
210 interior window frame/casing
220 exterior window opening
225. existing glass in window opening FIG. 1 is an exploded view of the novel block adapters 100, with fasteners 10, and securing bar 20 and plastic sheet/panel 30 for use with protecting window openings to a building or house. FIG. 2A is an enlarged upper front left perspective view of a novel block adapter 100 of FIG. 1. FIG. 2B is an upper front right perspective view of the block adapter 100 of FIG. 2A. FIG. 2C is another left front perspective view of the block adapter 100 of FIG. 2A. FIG. 2D is a front view of the block adapter 100 of FIG. 2A.

Referring to FIGS. 1-2D, the invention can include a pair of fasteners 10, bar/pipe 20, a pair of block adapters 100, and a plastic sheet/panel 30. The fasteners 10 can include carriage type bolts, with enlarged heads 12, threaded sides 14, washers 16 and nuts 18. Other types of fasteners, such as screws and the like, can also be used.

The securing bar 20 can an elongated metal pipe, and the like, that can be solid or hollow. Additionally, a solid plastic rod/bar can be used as well as PVC, and the like.

The plastic sheet panel 30 can be formed from polycarbonate material, and be sized to cover the opening to a window. The rigid transparent plastic panels 30, that can be used with the invention, include but are not limited to a rigid transparent plastic, such as but not limited to a solid transparent acrylic material, a solid transparent resinous material, or a transparent polycarbonate material, such as those sold under the trade names of LEXAN®, PLEXIGLASS® and the like, can be used.

Each of the block adapter(s) 100, can have a flat front face 110, convex curved top 112, fastener through-hole 115, convex curved bottom 118, flat rear face 120, left flat side 130, securing bar through-hole 135, and a right flat side 140.

The novel connecting block adapters 100 can have a generally rectangular block configuration and be approximately 1½ inches wide by approximately 2 inches tall by approximately 1½ inches thick. Other dimensions can be sized as needed. The connecting block adapters 100 can have two through-holes 115, 135, each perpendicular to one another as shown. A hole 115 for the fastener 10 can be approximately ½ inch in diameter, and the perpendicular hole 135 for a securing bar 20 can be approximately ¾ inch in diameter. The securing bar 20 can be a metal bar or pipe having an outer diameter sized to fit into the securing bar hole 135 in the connecting block, and be long enough to be wider than the width of the window opening.

The novel connecting block adapters 100 can be formed from plastic, wood, and metal, such as but not limited stainless steel, galvanized metal, aluminum, and the like. Additionally, the connector block adapters 100 can be formed from the same transparent material as the rigid transparent panels 30. The connector block adapters 100 can each be solid, honeycomb inside, or hollow.

Figure 3:
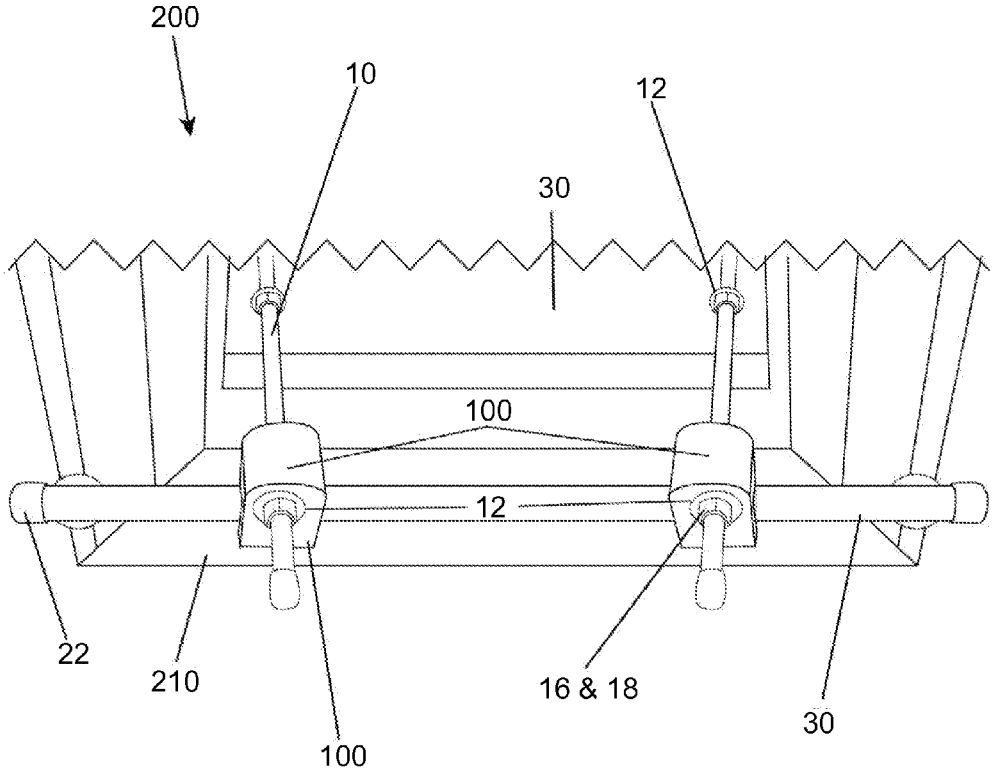
FIG. 3 is a partial perspective interior view of a window opening to a building or house with the novel block adapters and securing bar and fasteners of FIG. 1 on the inside of the opening, with exterior plastic panel on outside of window opening.
Figure 4:
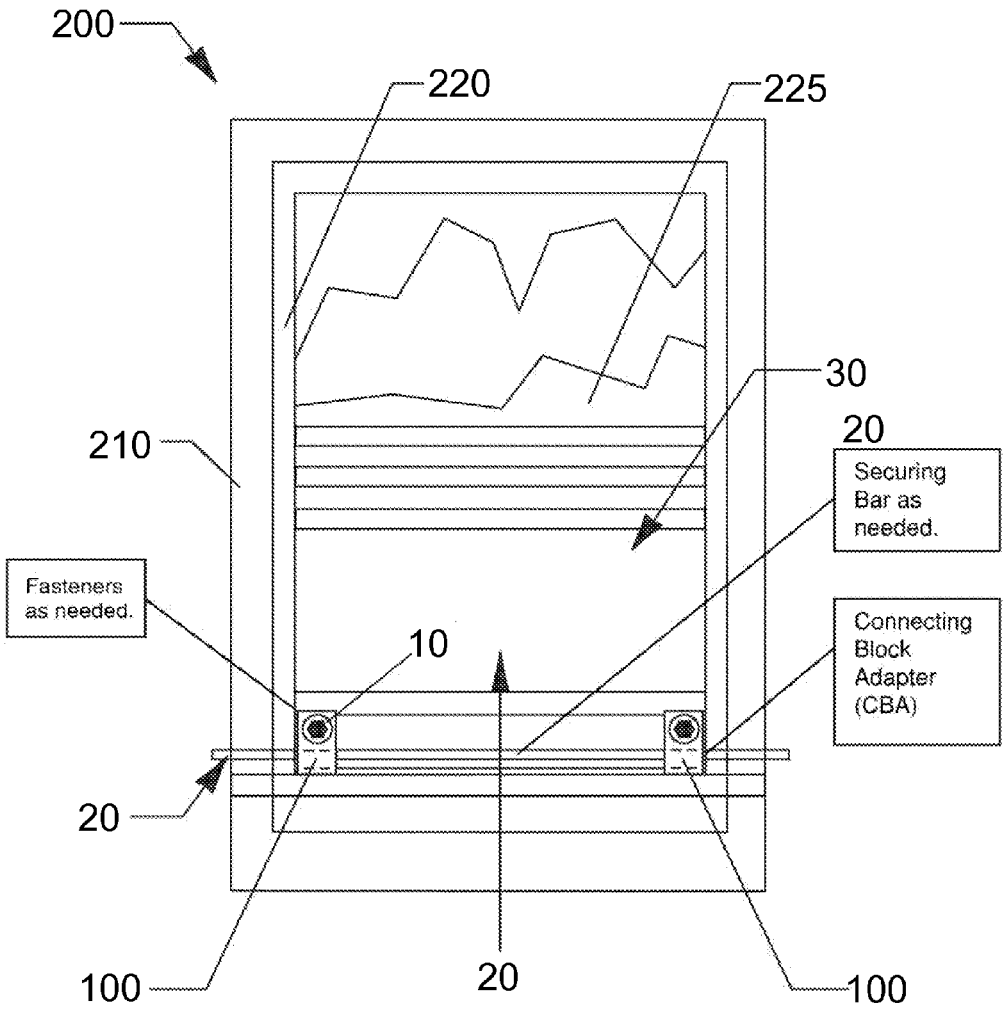
FIG. 4 is an interior view of the window opening with block adapters, securing bar and fasteners on the window opening of FIG. 3.
Figure 5:
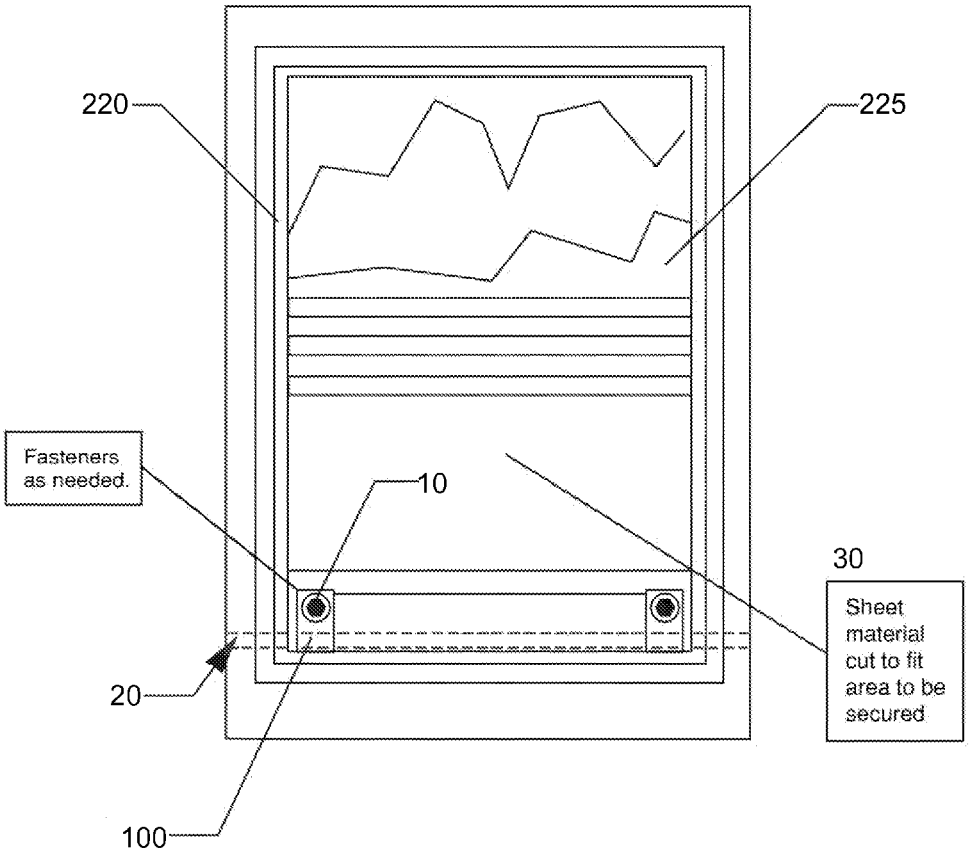
FIG. 5 is an exterior view of the window opening with block adapters, securing bar and fasteners on the window opening of FIG. 3.

FIG. 3 is a partial perspective interior assembled view of a window opening 220 to a building or house with the novel block adapters 100 and securing bar 20 and fasteners 10 of FIG. 1 on the inside of the opening, with exterior plastic panel 30 on outside of window opening. FIG. 4 is an interior view of the window opening 220 with block adapters 100, securing bar 20 and fasteners 10 and exterior plastic panel 30 on the window opening 220 of FIG. 3. FIG. 5 is an exterior view of the window opening 220 with block adapters 100, securing bar 20 and fasteners 10 with plastic panel 30 on the window opening 220 of FIG. 3.

Figure 6:
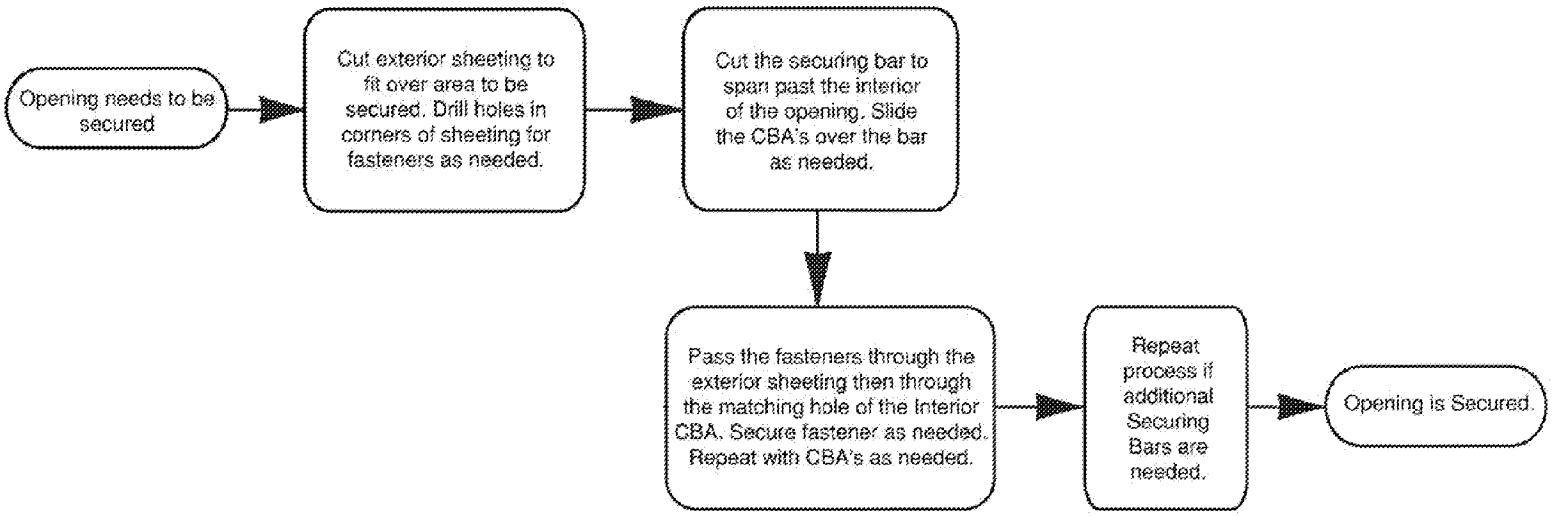
FIG. 6 is a flowchart of the installation steps to install a transparent plastic panel over an opening shown in FIGS. 3-5, using the connecting block adapters.

FIG. 6 is a flowchart of the installation steps to install a transparent plastic panel 30 over an opening shown in FIGS. 3-5, using the connecting block adapters 100.

Referring to FIGS. 3-6, an opening 220, such as a window opening in a building structure or house structure having broken glass 225, needs to be secured. The novel invention can install rigid transparent or opaque plastic panels 30 over the exterior of window openings 220 using the novel connecting block adapters 100.

The installer measures the window opening 220 to determine the size of the rigid transparent plastic panel 30 that is needed. The correct size is cut to cover part or the entire glass area 225 of the window opening 220. Next, the installer places the cut panel 30 over the exterior of the glass area 225 of the window opening 220.

Next, the installer places the novel connecting block adapters 100 on the bottom left and bottom right of the interior of the window opening 220, so that the connecting block adapters 100 overlap the bottom frame or casing of the window opening 220. The connecting block adapters 100 can be oriented vertically, or horizontally or even at an angle as needed.

Next, the installer will drill holes using a drill through the fastener hole(s) 115 of the connecting block adapter 100 and through the transparent plastic panels 30. A hole size in the plastic panels 30 can be approximately ½ inch. Alternatively, the connecting block adapters 100 can only have a securing bar hole 135, so that the fastener hole(s) 115 are drilled also therethrough.

Next, fasteners 10 such as bolts with nuts with washer(s) 16 can be used to secure the connecting block adapters 100 to the inside of the window and opening 220. The securing bar 20 can be slid through both connecting securing bar holes 135 in the connecting block adapters 100 so that outer ends of the securing bar 20 abut against interior portions of the frame/casing 210 on both sides of the window opening 220. Caps 22 can be used on the outer ends of the bar 20.

As a result, the exterior transparent plastic panel 30 can be sandwiched between the bolt head(s) 12 of the fasteners 10 and the securing bar 20. The bolt heads 12 can be on the outside of the window opening 220 and the nuts 18 on the inside rotated about the threads 14 of the fasteners 10. Alternatively, bolt heads 12 can be on the inside and nuts 18 on the outside. Additionally, washers 16, such as but not limited to locking washers can also be used as needed with the fasteners 10. Additionally, other types of fasteners 10 can be used, such as but not limited to carriage bolts, and screws, and the like.

In the preferred embodiment, other generic types of fasteners 10, such as but not limited to bolts, screws and the like, can also be used on the top edge(s) of the transparent plastic panel 30 to attach the panel to the frame/casing 210, without using the novel connecting block adapters 100. Additionally, the novel connecting block adapters 100 with another securing bar 20 can also be placed over the top right and top left transparent plastic panels 30 and similarly attached so that four block adapters 100 and two securing bars 20 can be used. The transparent rigid plastic panels 30 can be easily removed from covering the opening(s) by reversing the installation steps referenced above.

The connecting block adapters 100 can be an object of suitable size, shape, material and strength, intended to accept a threaded or unthreaded fastener in order to secure a cover over an opening. The connecting block adapters 100 can utilize holes of suitable size to insert a securing bar and the above mentioned fastener.

The fasteners 10 can be passed through the primary surface, the covering, to be secured. As mentioned, fastener holes 115 and/or securing bar holes 135 of suitable size can be drilled through the primary surface to allow the fasteners 10 to pass through. A suitable stop is on, or must be placed on the fastener to prevent it from going through the primary surface. The number of holes drilled and the number of connecting block adapters 100 used depends on the size of the opening to be covered and the type of covering material used.

The connecting block adapters 100 are generally placed over the securing bar 20. The securing bar 20 must be of sufficient length to allow it to span greater than the width of the window opening 220. The fasteners 10 that have already passed through the primary surface are then passed through the connecting block adapters 100 and secured against the surface with whatever pin, washer, nut, or other component required by the fasteners 10. The fasteners 10 can then be tightened against the connecting block adapters 100 to cause the securing bar 20 to tighten against the side surfaces of the opening 220 thereby drawing the primary surface (the cover) tightly against the opposite side of the opening.

Although the connecting block adapters 100 shown have a generally rectangular configuration, other geometrical shapes can be used Although the openings described in the preferred embodiment in relation to the Figures show a window opening, the invention can be used with other openings, such as but not limited to openings for doors and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A securing system for covering openings to buildings and housings, comprising:

a rigid panel sized to cover at least one exterior opening through a frame casing to a structure;

at least one pair of securing adapters, each of the adapters being sized to overlap both left and right corners of the rigid panel and portions of the frame casing;

fasteners for attaching the rigid panel to portions of the adapters; and a securing rod attached to other portions of the adapters, so that the rigid panel is on an exterior side of the structure opening and the adapters with the securing rod are on an interior side of the structure opening.

2. The securing system of claim 1, wherein the rigid panel and each of the adapters are selected from at least one of:

plastic, wood, and metal.

3. The securing system of claim 1, wherein each of the adapters include:

a first opening for a fastener; and a second opening perpendicular to the first fastener opening for allowing a portion of the securing rod to be inserted therein.

4. The securing system of claim 1, wherein the securing rod is selected from a bar or a pipe.

5. The securing system of claim 1, wherein each of the adapters are formed from rigid material identical to the rigid panel.

6. The securing system of claim 1, wherein the structure opening includes:

a window or door in the frame casing.

7. The securing system of claim 1, wherein the fasteners are selected from:

bolts, screws and nuts.

8. A method of securing openings on structures, comprising the steps of:

sizing a rigid panel to fit over an opening to a structure;

providing at least a pair of securing adapters;

providing at least one securing rod positioning the rigid panel over the exterior of the structure opening;

positioning one of the securing adapters to overlap over a left corner portion of an interior to the structure opening and over a portion of a left corner of a frame casing about the structure opening;

positioning another one of the securing adapters to overlap over a right corner portion of an interior to the structure opening and over a portion of a right corner of a frame casing about the structure opening;

attaching the securing adapters to the sized rigid panel with fasteners; and sliding the securing rod through openings in the adapters so that ends of the adapters abut against portions of the frame casing on side portions of the structure opening, wherein the structure opening is covered by the rigid panel.

9. The method of claim 8, wherein the rigid panel and each of the adapters are selected from at least one of:

plastic, wood, and metal.

10. The method of claim 8, wherein each of the adapters includes:

a first through-hole for the fastener; and a second through-hole perpendicular to the first through-hole for the securing rod.

11. The method of claim 8, wherein the securing rod is selected from a bar or pipe.

12. The method of claim 8, wherein each of the adapters are formed from rigid material identical to the rigid panel.

13. The method of claim 8, wherein the structure opening includes:

a window or door in the frame casing.

14. The method of claim 9, wherein the fasteners are selected from bolts, screws and nuts.

15. A protection kit for covering opening in structures, comprising:

a rigid panel sized to cover at least one exterior opening through a frame casing in a structure;

at least one pair of securing adapters, each being sized to overlap both left and right sides of the rigid panel and portions of the frame casing;

fasteners for attaching the rigid panel to portions of the adapters; and a securing rod attached to other portions of the adapters, so that the rigid panel is on an exterior side of the structure opening and the adapter with securing rod is on an interior side of the structure opening.

16. The kit of claim 15, wherein each of the adapters include:

a first opening for a fastener; and a second opening perpendicular to the fastener opening for allowing a portion of the securing rod to be inserted therein.

17. The kit of claim 15, wherein the rigid panel and the adapters are selected from:

plastic, wood and metal.

18. The kit of claim 15, wherein the securing rod is selected from a bar or a pipe.

19. The kit of claim 15, wherein the structure opening includes:

a window or door in the frame casing.

* * * * *